United States Patent [19]

Styfhoorn

[11] Patent Number: 4,798,086

[45] Date of Patent: Jan. 17, 1989

[54] TEST BENCH FOR TESTING HYDRAULIC PUMPS AND MOTORS

[75] Inventor: John Styfhoorn, Dunlap, Ill.

[73] Assignee: Caterpillar Inc., Peoria, Ill.

[21] Appl. No.: 29,498

[22] Filed: Mar. 23, 1987

[51] Int. Cl.[4] ..... F04B 51/00; F15B 19/00

[52] U.S. Cl. ..... 73/168; 73/112

[58] Field of Search ..... 73/168, 112; 417/63; 60/445, 449

[56] References Cited

U.S. PATENT DOCUMENTS

| | | | |
|---|---|---|---|
| 3,942,375 | 3/1976 | Shepherd | 73/168 |
| 4,368,638 | 1/1983 | Groves et al. | 73/168 |

FOREIGN PATENT DOCUMENTS

| | | | |
|---|---|---|---|
| 149929 | 11/1961 | U.S.S.R. | 73/168 |
| 723242 | 3/1980 | U.S.S.R. | 73/168 |
| 1262111 | 10/1986 | U.S.S.R. | 417/63 |

*Primary Examiner*—Stuart S. Levy
*Assistant Examiner*—Joseph J. Hail, III
*Attorney, Agent, or Firm*—John W. Grant

[57] ABSTRACT

Test benches are useful, for example, for testing the operation of new or repaired pumps and motors. Current test benches involve directly driving the test pump with an electric motor, the horsepower of which must at least equal the horsepower rating of the test pump. The subject test bench utilizes an electric motor to drive a variable displacement pressure compensated pump. The discharge fluid from the pump drives a variable displacement hydraulic motor which in turn drives the test pump. The discharge fluid from the test pump is also directed to the hydraulic motor to add additional driving energy thereto in a regenerative manner. Thus, pumps having a higher horsepower rating several times greater than the horsepower rating of the electric motor can be effectively tested at their maximum rated displacement and pressure settings. The electric motor also drives another variable displacement pressure compensated pump, the discharge flow of which is directed to a test motor. The test motor in turn drives the variable displacement motor which thus functions as a pump to direct pressurized fluid to the variable displacement pump, which in turn functions as a motor to add additional power to the variable displacement pump through the electric motor in a regenerative manner. Thus, motors having a higher horsepower rating than the horsepower of the electric motor can also be tested on the same test bench.

8 Claims, 2 Drawing Sheets

10
11
48
44
43
54
53
52
32
33
49
51
41
31
42
23
45
39
28
38
46a
34
46
36
37
29
26
47
24
56
59
27
71
69
68
58
70
63
57
67
65
61
66
62
21
20
14
13
72
73
74
17
19
16
18
22
26

10
12
44
43
32
33
34
49
51
53
56
52
31
41
42
23
28
38
46a
34
46
36
37
29
26
24
59
27
56
69
58
63
57
67
65
61
66
62
21
20
14
13
22
17
19
16
18
26

TEST BENCH FOR TESTING HYDRAULIC PUMPS AND MOTORS

TECHNICAL FIELD

This invention relates generally to a hydraulic test bench and more particularly to a test bench for testing hydraulic pumps and motors having horsepower ratings several times that of the primary power source of the test bench.

BACKGROUND ART

It is normal practice to test hydraulic pumps and motors under simulated working conditions after repairs are made thereto to ensure that they meet the rated specifications. Such hydraulic pumps and motors are currently tested on test benches by loading the pump and motors through a relief valve. These test benches commonly use an electric motor as the source of power. One of the problems encountered with that type of testing is that the test is limited to the direct input horsepower capacity of the electric drive motor. To provide an electric motor having sufficient horsepower to test many of today's high pressure, high volume pumps and motors is not feasible because of the size and cost of such high horsepower electric motors. Moreover, dumping the high volume of fluid across a relief valve at high pressure generates heat which would then necessitate the addition of large coolers to keep the oil cooled to the proper operating temperature.

One solution to the above problem is disclosed in U.S. Pat. No. 4,368,638 wherein the test bench has power regeneration features. The test bench thereof includes a primary power source which drives a gear train to which both a hydraulic pump and a hydraulic motor are mechanically connected. The hydraulic pump is driven by the gear train and transmits fluid to the hydraulic motor which converts the fluid pressure to mechanical power which is then used to drive the gear train. A disadvantage of such system is that the gear train would also take up considerable space and would have inherent frictional losses. Another disadvantage is that the pump and motor must run at the same speed such that the test bench could only be used to test pumps and motors at the normal operating speed of the gear train.

The present invention is directed to overcoming one or more of the problems as set forth above.

DISCLOSURE OF THE INVENTION

In one aspect of the present invention, a test bench for testing hydraulic pumps and motors includes a primary source of power, a first variable displacement hydraulic device mechanically connected to the power source, a second variable displacement hydraulic device having a drive shaft connectable to one of the hydraulic pump and motor to be tested, a fluid conduit interconnecting the first and second variable displacement hydraulic devices, means for communicating the discharge fluid from the test pump to the fluid conduit, means for controlling the displacement of the second variable displacement hydraulic device to maintain a constant preselected speed of the drive shaft, and means for adjustably controlling the displacement of the first variable displacement hydraulic device to control the fluid pressure in the conduit.

The present invention provides a test bench having a variable displacement hydraulic pump mechanically driven by an electric motor and fluidly connected to a variable displacement hydraulic motor which is then used to drive the test pump. The pressurized fluid discharged from the test pump is then directed to the hydraulic motor so that the available hydraulic power thereof is used to also drive the hydraulic motor in a regenerative manner. When the test bench is used for testing a hydraulic motor, the electric motor drives a different variable displacement hydraulic pump and the pressurized fluid therefrom is used to drive the test motor. The test motor is mechanically connected to a variable displacement hydraulic pump which is fluidly connected to a variable displacement motor which in turn is also mechanically connected to the electric motor. The power generated by the test motor during the testing thereof is thus used to drive the hydraulic pump connected thereto and the pressurized fluid discharged from the pump is used to drive the variable motor in a regenerative manner such that the power of the hydraulic fluid is additive to the electric motor. By using the power capabilities of the test pumps and motors in a regenerative manner, hydraulic pumps and motors having rated horsepowers many times that of the electric motor can be effectively tested. Moreover, the speed of the variable displacement motor is infinately variable between 0 and 2500 RPM and thus pumps and motors having different rated operating speeds can be tested on the same test bench.

BEST MODE FOR CARRYING OUT THE INVENTION

Figure 1:
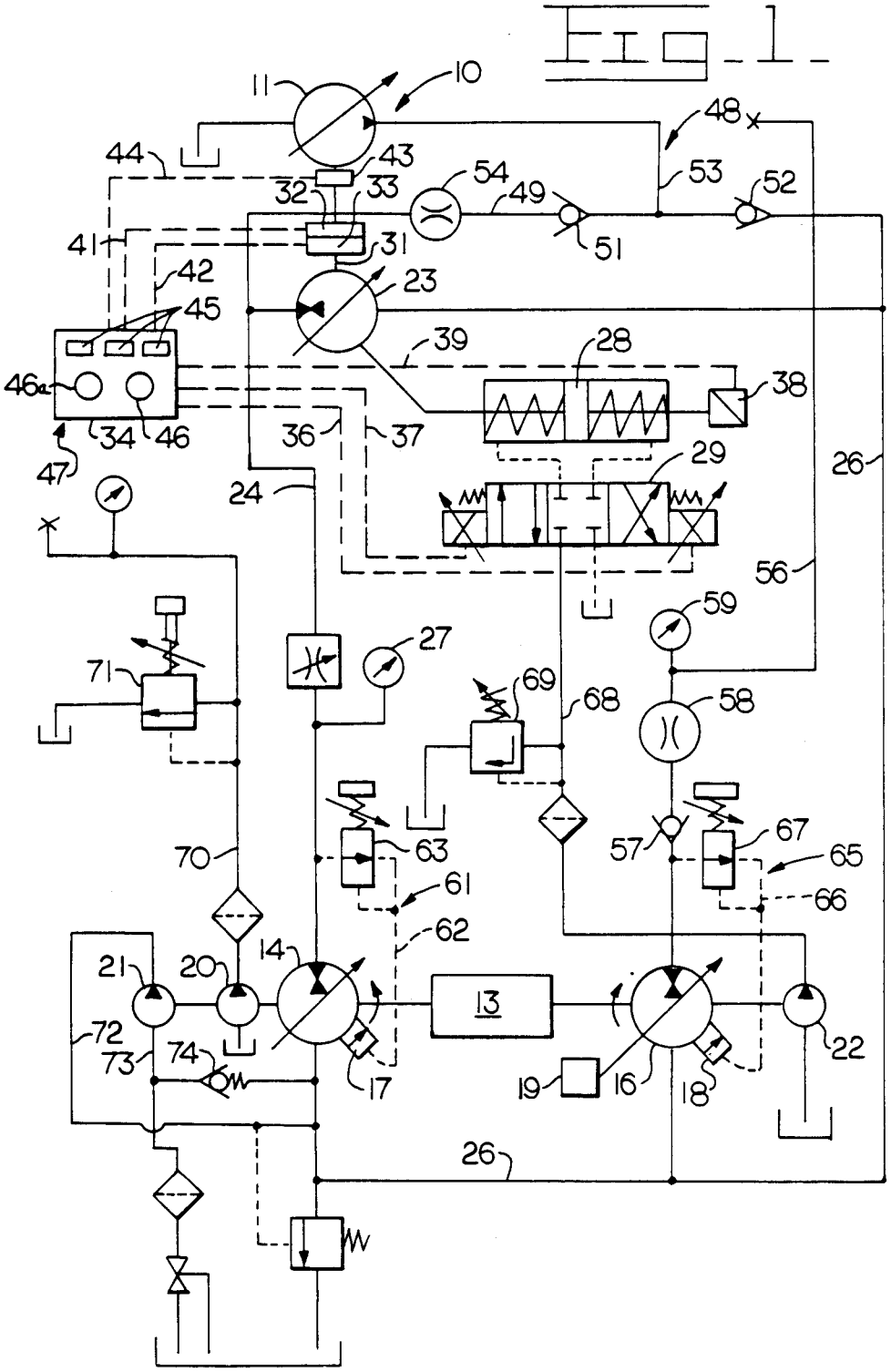
FIG. 1 is a schematic illustration of an embodiment of the present invention as utilized for testing a variable displacement hydraulic pump.

A test bench 10 for individually testing a hydraulic pump 11 (FIG. 1) or a hydraulic motor 12 (FIG. 2) includes an electric motor 13 as the primary source of power. A pair of variable displacement hydraulic devices 14, 16 are mechanically connected to the electric motor 13. The variable displacement hydraulic device 14 is a variable displacement pressure compensated pump having a pressure compensator control 17. The variable displacement hydraulic device 16 is also a variable displacement pressure compensated pump having a pressure compensator control 18 and a means 19 for selectively adjusting the maximum displacement setting of the pump. The means 19 can be either electrical, hydraulic or mechanical. A plurality of fixed displacement pumps 20, 21, 22 are also mechanically connected to the electric motor 13.

Another variable displacement hydraulic device 23 is fluidly connected to the variable displacement pump 14 in a closed loop manner through a pair of conduits 24, 26. A pressure gauge 27 is connected to the conduit 26. The variable displacement hydraulic device 23 functions as a variable displacement motor when the test bench 10 is used for testing the test pump 10 and as a variable displacement pump when the test bench is utilized for testing the test motor 12. The variable displacement hydraulic device includes a displacement control actuator 28 and a control valve 29 connected thereto for controlling its displacement. The variable displacement hydraulic device has a drive shaft 31 to which the test pump 11 or test motor 12 is releasably connected.

A speed sensor 32 and a torque sensor 33 are suitably connected to the drive shaft 31 to measure the speed of the shaft and the amount of torque transmitted through the shaft. The control valve 29 is a solenoid actuated proportional valve and is connected to a control box 34 through a pair of electrical leads 36, 37. A position sensor 38 is connected to the actuator 28 to monitor the displacement setting of the variable displacement hydraulic device 23 and is also connected to the control box through an electrical lead 39. Both the speed sensor 32 and torque sensor 33 are also connected to the control box through electrical leads 41, 42. A torque monitor 43 is suitably connected to the drive shaft 31 and is connected to the control box through an electrical lead 44. The control box 34 includes at least 3 digital readout gauges 45 which, are connected by internal wiring (not shown) to the electrical leads 44, 41, 39 to display the torque transmitted through the shaft, the shaft speed and the displacement setting of the variable displacement hydraulic device 23.

A speed control 46 is connected to the control box for adjustably setting the drive shaft speed of the variable displacement hydraulic device 23. The speed control 46, control box 34, speed sensor 32, control valve 29, and actuator 28 constitute a means 47 for controlling the displacement of the variable displacement device 23 to maintain a preselected constant speed of the drive shaft 31. A displacement control **46*a* is also connected to the control box 34** for adjustable setting the displacement of the variable displacement device.

A means 48 is provided for fluidly connecting the test pump 11 to the conduit 24 and includes a conduit 49 connected to the conduits 24 and 26, a pair of check valves 51, 52 disposed in the conduit 49, another conduit 53 connected to the conduit 49 between the check valves 51, 52 and being releasable connected to the test pump 11 and a flow meter 54 disposed in the conduit 49. When the test bench 10 is used to test the test motor 12 as shown in FIG. 2, the conduit 53 is disconnected from the test pump and the end thereof is suitable blocked.

Figure 2:
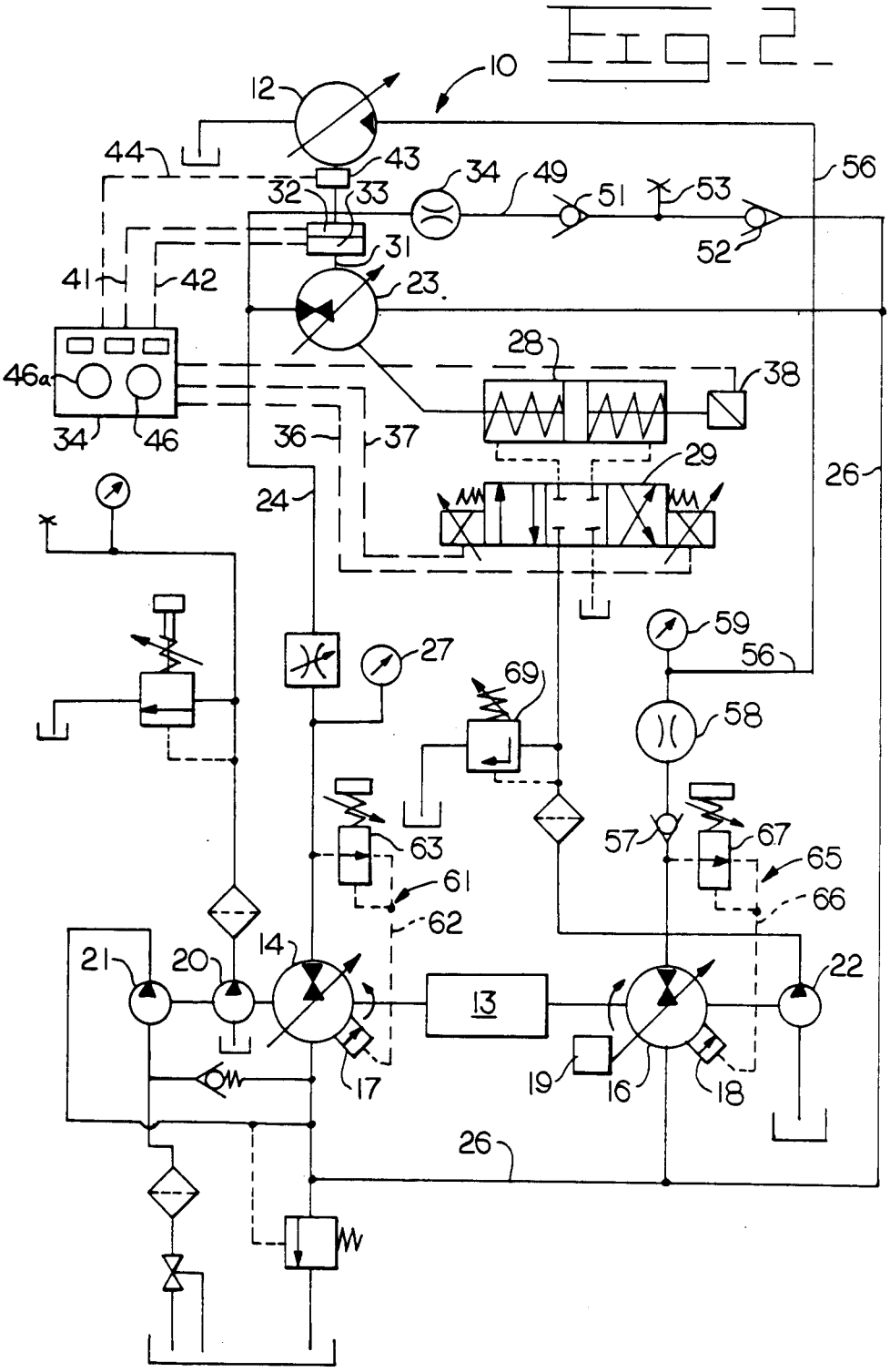
FIG. 2 is a schematic illustration of the test bench of FIG. 1 adapted to test a variable displacement hydraulic motor.

As more clearly shown in FIG. 2, a conduit 56 is connected to the variable displacement pump 16 and is releasable connected to the test motor 12. A check valve 57 and a flow meter 58 are disposed in the conduit 56 and a pressure gauge 59 connected to the conduit 56. The variable displacement pump 16 is also connected to the conduit 26. The conduit 56 is disconnected from the test motor 12 and the end thereof suitably blocked when the test bench is used for testing the test pump 11.

A means 61 is provided for selectively adjusting the pressure setting of the pressure compensator control 17 of the variable displacement device 14. The means 61, in this embodiment includes a pilot line 62 connected to the compensator control 17 and the conduit 24 and a selectively adjustable pressure control valve 63 disposed in the pilot line 62.

A means 65 is provided for selectively adjusting the pressure setting of the pressure compensator control 18 of the variable displacement device 16. The means 65 includes a pilot line 66 connected to the compensator control 18 and to the conduit 56 and a selectively adjustable pressure control valve 67 disposed in the pilot line 66.

A pilot line 68 connects the pump 22 to the control valve 29 for transmitting pilot fluid thereto. A relief valve 69 is connected to the pilot line 68 to maintain a predetermined pressure level in the pilot line 68. Another pilot line 70 is connected to the pump 20 and provides a source of pilot fluid necessary for controlling the operation of some pilot actuated pumps and motors. As shown in the drawings, the pilot line 70 is suitably blocked and has a selectably adjustable relief valve 71 connected thereto for controlling the pressure level therein. A conduit 72 connects the pump 21 to the conduit 26 to provide a precharge to the variable displacement devices 14 and 16. A conduit 73 connects the pump 21 to a tank and is connected to the conduit 26 through a makeup valve 74.

INDUSTRIAL APPLICABILITY

In the operation of the present invention the control box 34 is programmed to automatically adjust the displacement of the variable displacement hydraulic device 23 through the control valve 29 and actuator 28 to maintain the rotational speed of the shaft 31 at a preselected constant speed, as determined by the setting of the speed control 46, when the variable displacement device is functioning as a motor regardless of the volume of fluid passing through or the pressure level of the fluid in the conduit 24.

To test pumps on the test bench 10, the test pump 11 is mechanically releasably connected to the shaft 31 of the variable displacement hydraulic device 23 and fluidly connected to the conduit 24. The speed control 46 on the control box 34 is then set so that the variable displacement hydraulic device 23 will drive the test pump at its rated speed. The pressure control valve 63 is also preadjusted to a low pressure setting so that the pressure compensator control 17 will initially maintain the discharge pressure in the conduit 24 at a minimum standby pressure. The electric motor 13 is then energized to drive the variable displacement pump 14. The fluid discharged from the variable displacement pump 14 is directed through the conduit 24 to drive the variable displacement hydraulic device 23 which in turn drives the test pump 11. The fluid discharged from the test pump 11 is directed through the conduits 53, 49, the check valve 51, the flow meter 54 and is combined with the pressurized fluid from the variable displacement pump 14 flowing through the conduit 24 in a regenerative manner so that the available hydraulic power generated by the test pump 11 is used for driving the variable displacement hydraulic device 23. The pressure compensator control 17 of the variable displacement pump 14 immediately reduces the displacement of the variable displacement pump 14 to a setting that maintains the fluid pressure in the conduit 24 at the pressure level determined by the setting of the pressure control valve 63. Similarly, the displacement of the variable displacement hydraulic device 23 is changed so that the speed of the shaft 31 remains constant. Generally, the displacement of the variable displacement hydraulic device 23 will be slightly greater than the displacement of the test pump 11 with the displacement of the variable displacement pump 14 being adjusted to provide only enough fluid to makeup for fluid losses within the system. The setting of the pressure control valve 63 is then selectively adjusted in stages to incrementally increase the pressure setting of the compensator control 17 and hence the pressure level of the fluid in the conduit 24. Since the discharge fluid from the test pump 11 is working against the pressure in the conduit 24, any increase in the fluid pressure in the conduit 24 causes the discharge pressure level of the test pump 11 to increase thereby increasing the available hydraulic power of the fluid driving the variable displacement hydraulic device 23. The discharge flow of the test pump 11 passing through the flow meter 54, the pressure level of the fluid in the conduit 24 and the torque required to drive the test pump 11 are all monitored at the various stages. Those readings are plotted on a graph and compared with the standard curve to determine if the test pump is operating within the specifications thereof.

Many hydraulic motors can be tested as a pump and in such situations the test motor would be connected to the test bench identically to that of the test pump 11 described above.

When the test bench 10 is used for testing a hydraulic motor as a motor, the test motor 12 is mechanically connected to the drive shaft 31 and the conduit 56 connected thereto. The adjusting means 19 is adjusted to set the maximum displacement of the variable displacement pump 16 to be substantially equal to the rated maximum displacement of the test motor, the displacement control 46a is adjusted to preset the displacement of the variable displacement device 23 at a displacement setting slightly less than the rated maximum displacement of the test motor 12, and the pressure control valves 63 and 67 are initially adjusted to maintain the pressure level in the conduit 56 at a low standby pressure. The electric motor 13 is then energized to drive the variable displacement pump 16. The fluid discharge from the variable displacement pump 16 is directed through the conduit 56, check valve 57 and flow meter 58 to drive the test motor 12. The test motor 12 in turn drives the variable displacement hydraulic device 23 which now functions as a pump and directs pressurized fluid through the conduit 24. The pressurized fluid drives the variable displacement device 14 which now acts as a hydraulic motor and converts the hydraulic power into mechanical energy. The mechanical energy is added to the power generated by the electric motor 13. The pressure control valves 63 and 67 are selectively adjusted in stages to incrementally increase the pressure setting of the compensator controls 17, 18 and hence the pressure level of the fluid in the conduits 24 and 56. Increasing the pressure level of the fluid in the conduit 56 increases the power output of the test motor 12 which thereby increases the power output of the variable displacement device 23 driving the hydraulic pump 14 as a motor. The various parameters of the motor are continuously monitored and plotted on a graph to determine if the test motor is operating within the rated specifications.

In the embodiment shown, the electric motor is rated at 125 horsepower at a rotational speed of 1775 RPM. The variable displacement devices 14 and 16 are each rated at 125 cc and a maximum pressure of 414 bar. The variable displacement device 23 is rated at 250 cc displacement and a maximum pressure of 414 bar. The rated speed of the device 23 is 2500 RPM at the maximum displacement setting. It is theorized that with the speed of the variable displacement device 23 set at about 1800 RPM and at full displacement, this test bench can test pumps having a rating of about 450 horsepower by utilizing the regeneration feature.

In view of the foregoing, it is readily apparent that the structure of the present invention provides an improved test bench for the testing of pumps and motors having a horsepower rating several times the horsepower rating of the primary power source powering the test bench components. This is accomplished by utilizing the power generated by the test pump or motor for driving the components of the test bench in a regenerative manner. Also, by utilizing the variable displacement hydraulic device as the means for transferring power between the electrical motor and the test pump or motor, the test bench is more versatile. Moreover, the controls for controlling the displacement of the variable displacement devices are generally less complex than those required to control an electrical motor of the size capable of directly driving test pumps or motors having high horsepower ratings.

Other aspects, objects and advantages of this invention can be obtained from a study of the drawings, the disclosure and the appended claims.

I claim:

1. A test bench for testing hydraulic pumps and motors comprising:

a primary power source;

a first variable displacement hydraulic device mechanically connected to the power source;

a second variable displacement hydraulic device having a drive shaft connectable to one of a hydraulic pump and a hydraulic motor to be tested;

a conduit interconnecting the first and second variable displacement hydraulic devices;

means for communicating the discharge fluid from the test pump to the conduit when the drive shaft is connected to the test pump;

means for controlling the displacement of the second variable displacement hydraulic device to maintain a preselected constant speed of the drive shaft; and means for adjustably controlling the displacement of the first variable displacement hydraulic device to control the fluid pressure in the conduit.

2. The test bench of claim 1 wherein said communicating means includes a second conduit connected to the first mentioned conduit, a check valve disposed in the second conduit and a third conduit connected to the second conduit and being connectable to the test pump.

3. The test bench of claim 2 including a flow meter disposed in the second conduit.

4. The test bench of claim 1 wherein said first variable displacement hydraulic device includes a pressure compensator control, said means for adjustably controlling the displacement of the first variable displacement hydraulic device includes a pilot line connected to the first conduit and the pressure compensator control, and an adjustable pressure control valve disposed in the pilot line.

5. The test bench of claim 1 including a torque monitor connected to the shaft.

6. The test bench of claim 1 including a third variable displacement hydraulic device mechanically connected to the power source, another conduit connected to the third variable displacement hydraulic device and being connectable to the test motor when the drive shaft is connected to the test motor, and means for adjustably controlling the displacement of the third variable displacement hydraulic device to control the fluid pressure in said another conduit.

7. The test bench of claim 6 wherein said third variable displacement hydraulic device includes a pressure compensator control, said means for adjustably controlling the displacement of the third variable displacement hydraulic device includes a pilot line connected to said another conduit and to the pressure compensator control, and a selectively adjustable pressure control valve disposed in the pilot line.

8. A method of testing a hydraulic pump comprising the steps of driving a variable displacement pressure compensated pump with a primary power source;

transmitting the discharge fluid from the variable displacement pump to a variable displacement motor mechanically connected to the test pump for driving the test pump;

transmitting the discharge fluid from the test pump to the variable displacement motor in a regenerative manner;

controlling the displacement of the variable displacement motor for maintaining a preselected constant speed of the variable displacement motor; and adjustably controlling the displacement of the variable displacement pump to control the fluid pressure of the fluid transmitted to the variable displacement motor.

* * * * *